US007451675B1

(12) United States Patent
Johnson

(10) Patent No.: US 7,451,675 B1
(45) Date of Patent: Nov. 18, 2008

(54) POWER-OPERATED CUTTING BOARD

(76) Inventor: Sherry D. Johnson, 118 Mullally St., #3, Daytona Beach, FL (US) 32114

( * ) Notice: Subject to any disclaimer, the term of this patent is extended or adjusted under 35 U.S.C. 154(b) by 552 days.

(21) Appl. No.: 11/109,767

(22) Filed: Apr. 20, 2005

(51) Int. Cl.
*B26D 7/00* (2006.01)
*B27B 5/18* (2006.01)

(52) U.S. Cl. ..... 83/167; 83/102.1; 83/562; 83/599; 83/605

(58) Field of Classification Search ..... 83/167, 83/515, 599, 601, 605, 102.1, 477.2, 438, 83/479, 477.1, 574, 555, 562, 483, 29, 33, 83/422; 125/16.3, 18, 23.01, 16.03, 16.04
See application file for complete search history.

(56) References Cited

U.S. PATENT DOCUMENTS

| | | | | | |
|---|---|---|---|---|---|
| 950,099 | A | | 2/1910 | Fischer | |
| 1,817,678 | A | * | 8/1931 | Dunseth | 83/435 |
| 2,209,859 | A | * | 7/1940 | Taylor | 83/167 |
| 3,021,662 | A | * | 2/1962 | Yaniuk | 56/364 |
| 3,566,932 | A | * | 3/1971 | Papenmeier | 83/471.2 |
| 3,851,445 | A | | 12/1974 | Schuh | |
| 3,971,273 | A | | 7/1976 | Peters et al. | |
| 4,285,257 | A | * | 8/1981 | Eberle et al. | 83/167 |
| 4,418,594 | A | * | 12/1983 | Burns, Jr. | 83/19 |
| 4,441,003 | A | * | 4/1984 | Eves et al. | 219/700 |
| 4,516,612 | A | * | 5/1985 | Wiley | 144/1.1 |
| 4,750,442 | A | * | 6/1988 | Keeton | 112/470.05 |
| 5,050,472 | A | | 9/1991 | Potzsch | |
| 6,138,657 | A | | 10/2000 | Richard | |

* cited by examiner

*Primary Examiner*—Ghassem Alie

(57) ABSTRACT

A power-operable cutting board includes a plurality of stainless steel walls and a plurality of legs selectively attached thereto. One of the walls has an elongated height and defines a back board. A plurality of juxtaposed conveyor belts are positioned between the walls and define a substantially linear gap therebetween. The apparatus further includes a mechanism for rotating the belts in sync and a front wall having a plurality of slots formed therein. A cutting mechanism for selectively separating food products or their associated packages into multiple portions is also included. Such a cutting mechanism is adaptable between raised and lowered positions corresponding to operating and non-operating modes respectively. The cutting mechanism is independently operable from the rotating mechanism such that an operator can slice the food products and their associated packages manually as well.

15 Claims, 2 Drawing Sheets

POWER-OPERATED CUTTING BOARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a cutting board and, more particularly, to a power-operated cutting board for assisting a user to efficiently cut food products and their associated packages.

2. Prior Art

The slicing of meat roasts for serving on dinner menus of restaurants presents serious cost-control, weight-control, and quality-control problems. Meat roasts have a wide and non-uniform range in weights: from about 8 lbs. to 32 lbs. The portions that must ultimately be served to individual diners have a much narrower range in weights: from about 4 oz. to 12 oz. which present a tremendous challenge in cutting the larger and more cumbersome pieces of meat roasts.

In addition to their odd and non-uniform shapes, meat roasts can be portioned only after roasting. They must be roasted in their entirety and then sliced for individual servings afterward while they are hot and flabby. This makes them difficult to handle and control while slicing.

Most meat cutters have exposed blades at all times, during and after the cutting procedure. This presents a safety threat not only to the individuals using the cutter, but also to those in close vicinity to the cutter. Such cutters are only operable under manual force as well, which makes them tiresome and time consuming to use. When an individual becomes tired, the chance of sustaining a cut greatly increases.

Furthermore, most grocery stores and delis sell meats and other food products in prepackaged form. These packages in themselves are difficult to open, usually requiring the use of a knife or other sharp object that may slip and cut the user. It would be advantageous to have a means by which to cut such meats and their associated packages without the risk of getting hurt.

Accordingly, a need remains for a power-operated cutting board in order to overcome the above-noted shortcomings. The present invention satisfies such a need by providing a cutting board that is efficient, easy to use, provides convenience and improves user safety. Such a cutting board will eliminate the hassle of opening a package of cheese or meat by hand with a knife, which is dangerous, and time and energy-consuming. The safe, clean and hygienic cutting board appeals to both commercial workers as well as home owners.

BRIEF SUMMARY OF THE INVENTION

In view of the foregoing background, it is therefore an object of the present invention to provide a power-operable cutting board. These and other objects, features, and advantages of the invention are provided by an apparatus for assisting a user to efficiently cut food products and their associated packages.

The apparatus includes a plurality of stainless steel walls and a plurality of legs selectively attached thereto for defining a frame elevated at a fixed distance above ground level such that an operator can readily access the apparatus during operating conditions. One of the walls has an elongated height and is positioned rearward of the legs for defining a back board against which undesirable food and food package portions are conveniently deflected downwardly therealong.

A plurality of juxtaposed conveyor belts are positioned between the walls and have substantially planar surfaces along which the food products and their associated packages can be transported. Such belts define a substantially linear gap therebetween.

A mechanism is included for rotating the belts in sync along a unidirectional path traveling distally from a front one of the walls towards the back board. Such a front wall has a slot formed substantially medially therein.

Advantageously, a cutting mechanism selectively separates the food products or their associated packages into multiple portions as the food products or packages are guided along the belts. Such a cutting mechanism is adaptable between raised and lowered positions along a predetermined arcuate path corresponding to operating and non-operating modes respectively. The cutting mechanism is independently operable from the rotating mechanism such that an operator can conveniently slice the food products and their associated packages manually while the belts are at a stationary position.

The cutting mechanism preferably includes a control switch mounted to the front wall and a plurality of motors electrically coupled to an external power supply source and the control switch. Such motors include a plurality of drive shafts and a plurality of corresponding drive belts operably connected thereto. A plurality of juxtaposed rollers are included, each having a central axle for defining a fulcrum axis respectively. The rollers are operably connected to the drive belts and rotatable in sync therewith such that the belts are caused to travel along the unidirectional path.

An elongated lever has opposed end portions nested within the slot and is disposed adjacent to the back board respectively. A blade is operably attached to the handle and includes a sharpened edge selectively positionable through the gap as the handle is moved between raised and lowered positions. Such a blade has a proximal end portion pivotally connected to the front wall. An operator can conveniently toggle the apparatus between operating and non-operating modes by depressing the switch.

The apparatus may further include a plurality of bins preferably aligned substantially horizontally beneath the belts for advantageously collecting the undesirable food and package portions therein. Such bins are slidably positionable subjacent to the belts and spaced proximally of the back board for defining a gap therebetween through which the undesirable food and package portions can conveniently be directed into the bins. The bins are preferably removable from the frame along a laterally defined path and include a plurality of handles attached thereto for advantageously assisting a user to readily empty any contents thereof during non-operating conditions.

Each of the bins preferably includes a raised front lip portion sized and shaped for frictionally engaging respective ones of the belt surfaces such that any undesirable food and package portions can be effectively removed therefrom and collected into the bins during each revolution of the belts.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
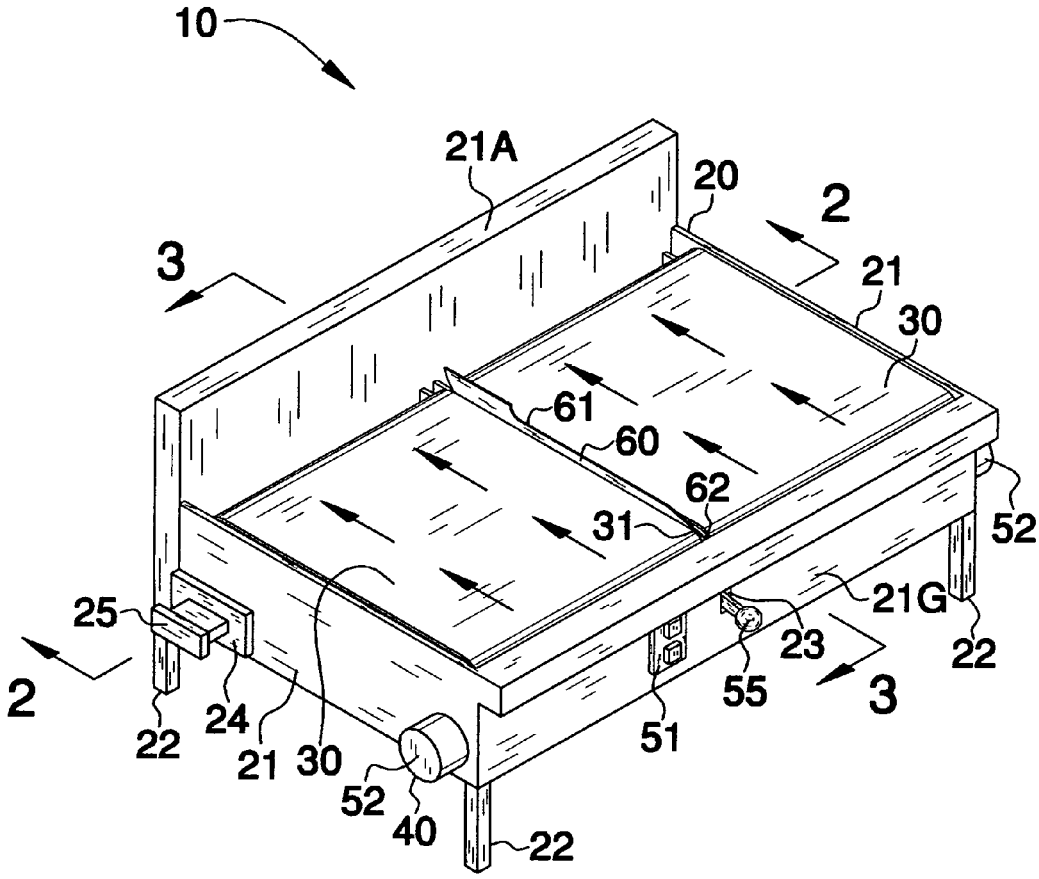
FIG. 1 is a perspective view showing a power operable cutting board for assisting a user to efficiently cut food products and their associated packages, in accordance with the present invention.
Figure 2:
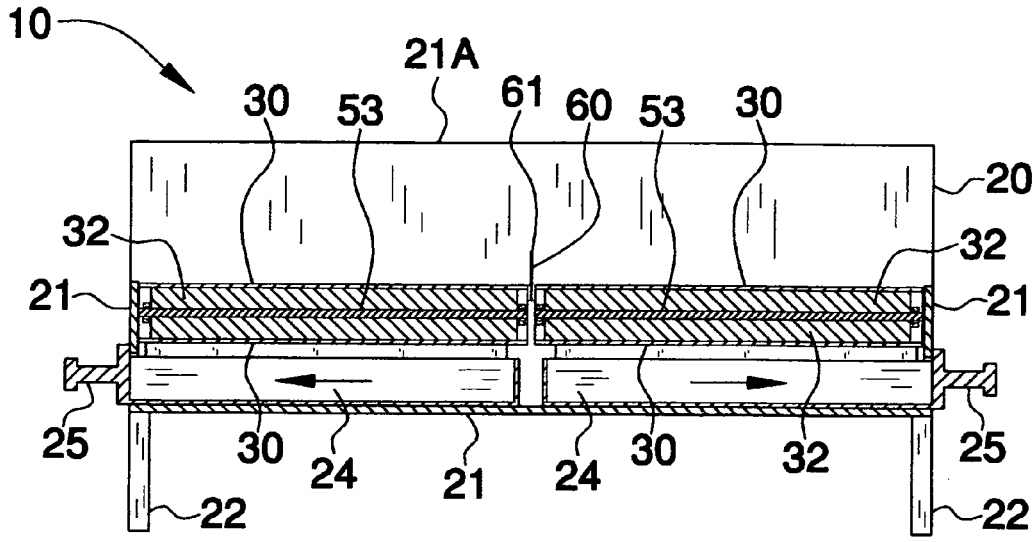
FIG. 2 is a cross-sectional view of the apparatus shown in FIG. 1, taken along line 2-2.
Figure 3:
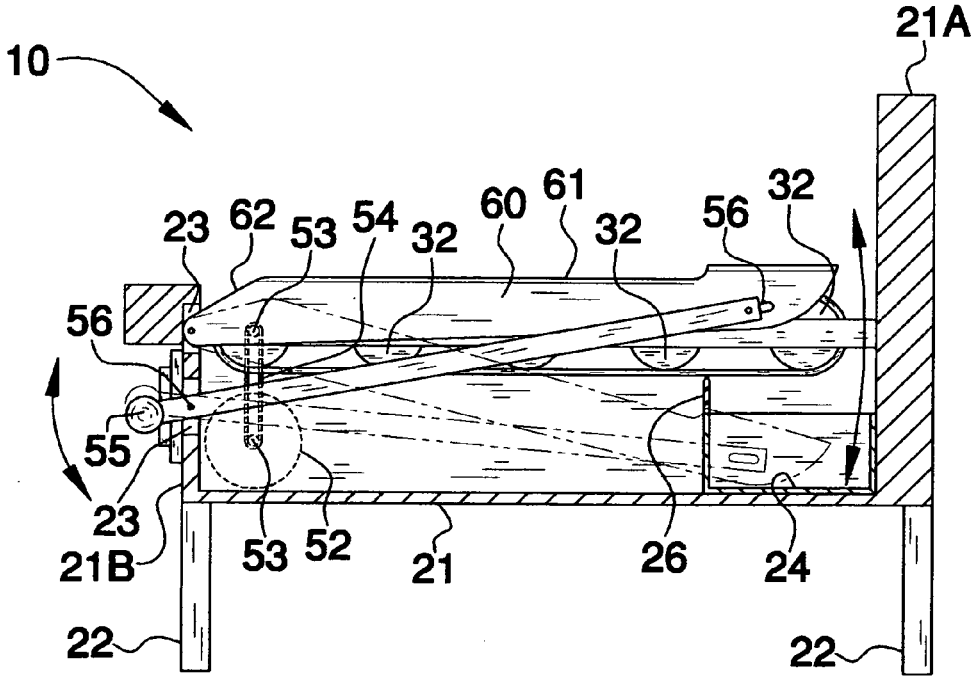
FIG. 3 is a cross-sectional view of the apparatus shown in FIG. 1, taken along line 3-3.

The apparatus of this invention is referred to generally in FIGS. 1-3 by the reference numeral 10 and is intended to provide a power-operable cutting board. It should be understood that the apparatus 10 may be used to cut many different types of materials and should not be limited to the cutting of only food packages.

Referring initially to FIG. 1, the apparatus 10 includes a plurality of stainless steel walls 21 and a plurality of legs 22 selectively attached thereto for defining a frame 20 elevated at a fixed distance above ground level such that an operator can readily access the apparatus 10 during operating conditions. One of the walls 21*a* has an elongated height and is positioned rearward of the legs 22 for defining a back board 21*a* against which undesirable food and food package portions are conveniently deflected downwardly therealong. Such a raised back board 21*a* conveniently prevents food and food package portions from falling onto the floor and becoming an eye-sore or a slip and fall hazard.

Referring to FIGS. 1 and 2, a plurality of juxtaposed conveyor belts 30 are positioned between the walls 21 and have substantially planar surfaces along which the food products and their associated packages can be transported. Such belts 30 define a substantially linear gap 31 therebetween.

Referring to FIG. 1, a mechanism 40 is included for rotating the belts 30 in sync along a unidirectional path traveling distally from a front one of the walls 21*b* towards the back board 21*a*. Such a front wall 21*b* has a slot 23 formed substantially medially therein. The rotating mechanism 40 advantageously allows an individual the use of both hands to manipulate the food or food package being cut, thus improving the safety of the apparatus 10.

Referring to FIGS. 1, 2 and 3, a cutting mechanism 50 selectively separates the food products or their associated packages into multiple portions as the food products or packages are guided along the belts 30. Such a cutting mechanism 50 is adaptable between raised and lowered positions along a predetermined arcuate path corresponding to operating and non-operating modes respectively, as best shown in FIG. 3. The cutting mechanism 50 is independently operable from the rotating mechanism 40 such that an operator can conveniently slice the food products and their associated packages manually while the belts 30 are at a stationary position.

Referring to FIGS. 1 and 3, the mechanism 40 includes a control switch 51 mounted to the front wall 21*b* and a plurality of motors 52 electrically coupled to an external power supply source and the control switch 51. An operator can conveniently toggle the apparatus 10 between operating and non-operating modes by depressing the switch 51. The motors 52 include a plurality of drive shafts 53 and a plurality of corresponding drive belts 54 operably connected thereto. A plurality of juxtaposed rollers 32 are included, each having a central axle for defining a fulcrum axis respectively. The rollers 32 are operably connected to the drive belts 54 and rotatable in sync therewith such that the belts 30 are caused to travel along the unidirectional path.

An elongated lever 55 has opposed end portions 56 nested within the slot 23 and is disposed adjacent to the back board 21*a* respectively. A blade 60 is operably attached to the lever 55 and includes a sharpened edge 61 selectively positionable through the gap 31 as the lever 55 is moved between raised and lowered positions. Such a blade 60 has a proximal end portion 62 pivotally connected to the front wall 21*b*.

Referring to FIGS. 2 and 3, the apparatus 10 further includes a plurality of bins 24 aligned substantially horizontally beneath the belts 30 for advantageously collecting the undesirable food and package portions therein. Such bins 24 are slidably positionable subjacent to the belts 30 and spaced proximally of the back board 21*a* for defining a gap therebetween through which the undesirable food and package portions can conveniently be directed into the bins. The bins 24 are removable from the frame 20 along a laterally defined path and include a plurality of handles 25 attached thereto for advantageously assisting a user to readily empty any contents thereof during non-operating conditions. This feature allows for easy and quick cleaning of the apparatus 10, and thus advantageously decreases the amount of time required to cut food and subsequently clean the undesirable parts thereof afterwards.

Referring to FIG. 3, each of the bins 24 includes a raised front lip portion 26 sized and shaped for frictionally engaging respective ones of the belt 30 surfaces such that any undesirable food and package portions can be effectively removed therefrom and collected into the bins 24 during each revolution of the belts 30. Such a raised front lip portion 26 conveniently decreases the effort needed to clean the belts 30 after operating procedures are completed as most of the undesirable food portions are automatically removed by the motion of the belts 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for assisting a user to efficiently cut food products, said apparatus comprising:

a plurality of walls and a plurality of legs selectively attached thereto for defining a frame elevated at a fixed distance above ground level such that an operator can readily access said apparatus during operating conditions, one said walls having an elongated height and being positioned rearward of said legs for defining a back board against which undesirable food portions are deflected downwardly therealong;

a plurality of juxtaposed conveyor belts positioned between said walls and having substantially planar surfaces along which the food products can be transported, said belts defining a substantially linear gap therebetween;

means for rotating said belts in a unidirectional path traveling distally from a front one of said walls and towards said back board, said front wall having a slot formed therein; and cutting means for separating the food products into multiple portions as the food products are guided along said belts, said cutting means being adaptable between raised and lowered positions corresponding to operating and non-operating modes respectively;

wherein said belt rolling means comprises a control switch mounted to said front wall;

a plurality of motors electrically coupled to an external power supply source and said control switch, said motors including a plurality of drive shafts and a plurality of corresponding drive belts operably connected thereto;

a plurality of juxtaposed rollers each having central axles for defining a fulcrum axes respectively, said rollers being operably connected to said drive belts and rotatable in sync therewith such that said belts are caused to travel along the unidirectional path;

an elongated lever having opposed end portions nested within said slot and disposed adjacent said back board respectively; and a blade operably attached to said handle and including a sharpened edge selectively positionable through the gap as said handle is moved between raised and lowered positions, said blade having a proximal end portion pivotally connected to said front wall;

wherein an operator can toggle said apparatus between operating and non-operating modes by depressing said switch.

2. The apparatus of claim 1, further comprising:

a plurality of bins for collecting the undesirable food portions therein, said bins being slidably positionable subjacent said belts and spaced proximally of said back board for defining a gap therebetween and through which the undesirable food portions can be directed into said bins.

3. The apparatus of claim 2, wherein said bins are removable from said frame along a laterally defined path, said bins including a plurality of handles attached thereto for assisting a user to readily empty any contents thereof during non-operating conditions.

4. The apparatus of claim 2, wherein said bins are aligned substantially horizontally beneath said belts.

5. The apparatus of claim 2, wherein each of said bins comprises: a raised front lip portion sized and shaped for frictionally engaging respective ones of said belt surfaces such that any undesirable food portions can be effectively removed therefrom and collected into said bins during each revolution of said belts.

6. An apparatus for assisting a user to efficiently cut food products, said apparatus comprising:

a plurality of walls and a plurality of legs selectively attached thereto for defining a frame elevated at a fixed distance above ground level such that an operator can readily access said apparatus during operating conditions, one said walls having an elongated height and being positioned rearward of said legs for defining a back board against which undesirable food portions are deflected downwardly therealong;

a plurality of juxtaposed conveyor belts positioned between said walls and having substantially planar surfaces along which the food products can be transported, said belts defining a substantially linear gap therebetween;

means for rotating said belts in sync and along a unidirectional path traveling distally from a front one of said walls and towards said back board, said front wall having a slot formed therein; and cutting means for selectively separating the food products into multiple portions as the food products are guided along said belts, said cutting means being adaptable between raised and lowered positions corresponding to operating and non-operating modes respectively, said cutting means being independently operable from said rotating means such that an operator can manually slice the food products while said belts are at a stationary position;

wherein said belt rolling means comprises a control switch mounted to said front wall;

a plurality of motors electrically coupled to an external power supply source and said control switch, said motors including a plurality of drive shafts and a Plurality of corresponding drive belts operably connected thereto;

a plurality of juxtaposed rollers each having central axles for defining a fulcrum axes respectively, said rollers being operably connected to said drive belts and rotatable in sync therewith such that said belts are caused to travel along the unidirectional path;

an elongated lever having opposed end portions nested within said slot and disposed adjacent said back board respectively; and a blade operably attached to said handle and including a sharpened edge selectively positionable through the gap as said handle is moved between raised and lowered positions, said blade having a proximal end portion pivotally connected to said front wall;

wherein an operator can toggle said apparatus between operating and non-operating modes by depressing said switch.

7. The apparatus of claim 6, further comprising:

a plurality of bins for collecting the undesirable food portions therein, said bins being slidably positionable subjacent said belts and spaced proximally of said back board for defining a gap therebetween and through which the undesirable food portions can be directed into said bins.

8. The apparatus of claim 7, wherein said bins are removable from said frame along a laterally defined path, said bins including a plurality of handles attached thereto for assisting a user to readily empty any contents thereof during non-operating conditions.

9. The apparatus of claim 7, wherein said bins are aligned substantially horizontally beneath said belts.

10. The apparatus of claim 7, wherein each of said bins comprises: a raised front lip portion sized and shaped for frictionally engaging respective ones of said belt surfaces such that any undesirable food portions can be effectively removed therefrom and collected into said bins during each revolution of said belts.

11. An apparatus for assisting a user to efficiently cut food products, said apparatus comprising:

a plurality of stainless steel walls and a plurality of legs selectively attached thereto for defining a frame elevated at a fixed distance above ground level such that an operator can readily access said apparatus during operating conditions, one said walls having an elongated height and being positioned rearward of said legs for defining a back board against which undesirable food portions are deflected downwardly therealong;

a plurality of juxtaposed conveyor belts positioned between said walls and having substantially planar surfaces along which the food products can be transported, said belts defining a substantially linear gap therebetween;

means for rotating said belts in sync and along a unidirectional path traveling distally from a front one of said walls and towards said back board, said front wall having a slot formed substantially medially therein; and cutting means for selectively separating the food products into multiple portions as the food products are guided along said belts, said cutting means being adaptable between raised and lowered positions and along a predetermined arcuate path corresponding to operating and non-operating modes respectively, said cutting means being independently operable from said rotating means such that an operator can manually slice the food products while said belts are at a stationary position;

wherein said belt rolling means comprises a control switch mounted to said front wall;

a plurality of motors electrically coupled to an external power supply source and said control switch, said motors including a plurality of drive shafts and a plurality of corresponding drive belts operably connected thereto;

a plurality of juxtaposed rollers each having central axles for defining a fulcrum axes respectively, said rollers being operably connected to said drive belts and rotatable in sync therewith such that said belts are caused to travel along the unidirectional path;

an elongated lever having opposed end portions nested within said slot and disposed adjacent said back board respectively; and a blade operably attached to said handle and including a sharpened edge selectively positionable through the gap as said handle is moved between raised and lowered positions, said blade having a proximal end portion pivotally connected to said front wall;

wherein an operator can toggle said apparatus between operating and non-operating modes by depressing said switch.

12. The apparatus of claim 11, further comprising:

a plurality of bins for collecting the undesirable food portions therein, said bins being slidably positionable subjacent said belts and spaced proximally of said back board for defining a gap therebetween and through which the undesirable food portions can be directed into said bins.

13. The apparatus of claim 11, wherein said bins are removable from said frame along a laterally defined path, said bins including a plurality of handles attached thereto for assisting a user to readily empty any contents thereof during non-operating conditions.

14. The apparatus of claim 11, wherein said bins are aligned substantially horizontally beneath said belts.

15. The apparatus of claim 11, wherein each of said bins comprises: a raised front lip portion sized and shaped for frictionally engaging respective ones of said belt surfaces such that any undesirable food portions can be effectively removed therefrom and collected into said bins during each revolution of said belts.

* * * * *